US005829175A

United States Patent [19]

Marchetti et al.

[11] Patent Number: 5,829,175

[45] Date of Patent: Nov. 3, 1998

[54] STEAM IRON WITH ALL TEMPERATURE STEAM PRODUCTION

[75] Inventors: Michael John Marchetti, Bridgeport; Lee H. Eckert, Cheshire, both of Conn.

[73] Assignee: Black & Decker Inc., Newark, Del.

[21] Appl. No.: 716,962

[22] Filed: Sep. 20, 1996

[51] Int. Cl.[6] ..... D06F 75/18

[52] U.S. Cl. ..... 38/77.8

[58] Field of Search ..... 38/77.7, 77.8, 38/77.83; 219/247, 251; 251/205, 208, 215, 229

[56] References Cited

U.S. PATENT DOCUMENTS

| | | | |
|---|---|---|---|
| 545,769 | 9/1895 | Bowman . | |
| 2,014,642 | 9/1935 | Andrews | 251/75 |
| 2,298,212 | 10/1942 | Huston | 251/29 |
| 2,313,382 | 3/1943 | Kistner | 38/77 |
| 2,317,706 | 4/1943 | Woodman . | |
| 2,336,603 | 12/1943 | Foulds et al. | 251/29 |
| 2,337,077 | 12/1943 | Woodman . | |
| 2,342,653 | 2/1944 | Edwards . | |
| 2,342,716 | 2/1944 | Woodman . | |

(List continued on next page.)

FOREIGN PATENT DOCUMENTS

| | | |
|---|---|---|
| 0 014 643 | 8/1980 | European Pat. Off. . |
| 80 400 155 | 3/1981 | European Pat. Off. . |
| 0 184 496 | 5/1988 | European Pat. Off. . |
| 0420451 | 4/1991 | European Pat. Off. . |
| 0543533 | 5/1993 | European Pat. Off. . |
| 0543534 | 5/1993 | European Pat. Off. . |
| 0607548 | 7/1994 | European Pat. Off. . |
| 0647735 | 4/1995 | European Pat. Off. . |
| 0674037 | 9/1995 | European Pat. Off. . |
| 0758032 | 2/1997 | European Pat. Off. . |
| 1316012 | 12/1962 | France . |
| 1508112 | 1/1968 | France . |
| 2 176 839 | 11/1973 | France . |
| 2 290 524 | 6/1976 | France . |
| 2 206 461 | 6/1977 | France . |
| 2 337 780 | 8/1977 | France . |
| 2 449 157 | 9/1980 | France . |
| 2 573 783 | 5/1986 | France . |
| 2 626 901 | 8/1989 | France . |
| 448 044 | 3/1968 | Germany . |
| 15 85 764 | 10/1970 | Germany . |
| 25 46 904 | 7/1977 | Germany . |
| 2732119 | 5/1979 | Germany . |
| 30 29 976 | 5/1982 | Germany . |
| 3437825 | 8/1986 | Germany . |
| 3603229 | 8/1986 | Germany . |
| 3635785 | 5/1987 | Germany . |
| G 89 12 908.3 | 4/1990 | Germany . |
| 278827 | 5/1990 | Germany . |
| 3942347 | 7/1991 | Germany . |
| 4133254 | 4/1993 | Germany . |
| 4133255 | 4/1993 | Germany . |
| 4133256 | 4/1993 | Germany . |
| 259103 | 1/1949 | Switzerland . |
| 570409 | 7/1945 | United Kingdom . |
| 608017 | 9/1948 | United Kingdom . |
| 767929 | 2/1957 | United Kingdom . |
| 926945 | 5/1963 | United Kingdom . |
| 951532 | 3/1964 | United Kingdom . |
| 2 113 723 | 8/1983 | United Kingdom . |
| 2170826 | 8/1986 | United Kingdom . |
| 2183257 | 6/1987 | United Kingdom . |
| 2217352 | 10/1989 | United Kingdom . |
| WO 92/00411 | 1/1992 | WIPO . |

*Primary Examiner*—Ismael Izaguirre

*Attorney, Agent, or Firm*—Barry E. Deutsch; Kerry H. Owens

[57] ABSTRACT

A steam iron with a valve between the water reservoir and the soleplate. The valve has a valve stem that is connected to the temperature control. The valve stem is axially rotated when the temperature control is moved without longitudinally moving the valve stem. The valve stem has a groove of varying depth located between an inlet and an outlet of the valve member to vary the flow of water through the valve based upon the rotational position of the valve stem relative to the valve member. A user actuated mechanism is also provided to longitudinally move the valve stem among closed, variable, and non-variable open flow positions.

17 Claims, 4 Drawing Sheets

U.S. PATENT DOCUMENTS

| | | | |
|---|---|---|---|
| 2,384,839 | 9/1945 | Kistner | 38/77 |
| 2,411,199 | 11/1946 | Felver . | |
| 2,418,511 | 4/1947 | Hume | 38/77 |
| 2,425,598 | 8/1947 | Clum | 38/77 |
| 2,427,521 | 9/1947 | Butman | 38/77 |
| 2,431,545 | 11/1947 | Dykes | 38/77 |
| 2,441,586 | 5/1948 | Morton . | |
| 2,483,816 | 10/1949 | Edwards . | |
| 2,499,835 | 3/1950 | Rakos | 38/77 |
| 2,556,780 | 1/1951 | Shryock . | |
| 2,588,747 | 3/1952 | Morton | 38/77 |
| 2,609,205 | 9/1952 | Moen . | |
| 2,655,746 | 10/1953 | McFarland et al. . | |
| 2,668,378 | 2/1954 | Vance | 38/77 |
| 2,729,904 | 1/1956 | Maykemper | 38/77 |
| 2,744,342 | 5/1956 | More . | |
| 2,786,286 | 3/1957 | Brace | 38/77 |
| 2,794,275 | 6/1957 | Hoecker | 38/77 |
| 2,805,497 | 9/1957 | Gomersall | 38/77 |
| 2,813,358 | 11/1957 | Jepson | 38/77 |
| 2,853,814 | 9/1958 | Brandler et al. | 38/77 |
| 2,883,779 | 4/1959 | Krause et al. | 38/77 |
| 2,887,800 | 5/1959 | Kistner . | |
| 2,903,804 | 9/1959 | Kistner . | |
| 2,952,086 | 9/1960 | Kistner et al. . | |
| 2,976,627 | 3/1961 | Kistner et al. . | |
| 3,111,780 | 11/1963 | Smith . | |
| 3,136,080 | 6/1964 | Albrecht . | |
| 3,165,843 | 1/1965 | Willman | 38/77 |
| 3,305,211 | 2/1967 | Phillips | 251/309 |
| 3,325,143 | 6/1967 | Phillips | 251/311 |
| 3,410,521 | 11/1968 | Sowers, III et al. | 251/205 |
| 3,475,002 | 10/1969 | Phillips | 251/155 |
| 3,599,357 | 8/1971 | Gronwick et al. | 38/77.5 |
| 3,691,660 | 9/1972 | Gronwick et al. | 38/77.5 |
| 3,698,683 | 10/1972 | De Angelis | 251/209 |
| 3,728,805 | 4/1973 | Gowdy | 38/77.83 |
| 3,747,241 | 7/1973 | Davidson | 38/77.83 |
| 3,811,208 | 5/1974 | Vieceli et al. | 38/77.8 |
| 3,849,916 | 11/1974 | Davidson et al. | 38/77.83 |
| 3,903,625 | 9/1975 | Augustine | 38/77.2 |
| 4,016,663 | 4/1977 | Cline et al. | 38/77.83 |
| 4,070,773 | 1/1978 | Gowdy | 38/77.83 |
| 4,079,528 | 3/1978 | Lindstaedt et al. | 38/77.83 |
| 4,107,860 | 8/1978 | Coggiola | 38/77.83 |
| 4,125,953 | 11/1978 | Colombo | 38/77.7 |
| 4,203,026 | 5/1980 | Walter et al. | 219/222 |
| 4,296,560 | 10/1981 | Schwob | 38/77.81 |
| 4,398,364 | 8/1983 | Augustine et al. | 38/77.5 |
| 4,414,766 | 11/1983 | Schwob | 38/77.83 |
| 4,459,771 | 7/1984 | Ogata | 38/77.8 |
| 4,627,181 | 12/1986 | Bastida | 38/77.7 |
| 4,656,763 | 4/1987 | Kawasaki et al. | 38/77.83 |
| 4,669,207 | 6/1987 | Hennuy et al. | 38/77.5 |
| 4,688,339 | 8/1987 | Tsai | 38/77.3 |
| 4,748,755 | 6/1988 | Bain, Jr. et al. | 38/88 |
| 4,780,973 | 11/1988 | Vildosola | 38/77.7 |
| 4,789,000 | 12/1988 | Aslanian | 137/556 |
| 4,802,506 | 2/1989 | Aslanian . | |
| 4,837,952 | 6/1989 | Hennuy et al. | 38/77.7 |
| 4,870,763 | 10/1989 | Campbell | 38/77.7 |
| 4,939,342 | 7/1990 | Frens et al. | 219/251 |
| 5,120,934 | 6/1992 | Nakada et al. | 219/247 |
| 5,121,464 | 6/1992 | Hanada et al. | 392/405 |
| 5,170,577 | 12/1992 | Brandolini et al. | 38/77.8 |
| 5,195,678 | 3/1993 | Giasson et al. | 236/93 R |
| 5,345,060 | 9/1994 | Hazan et al. | 219/250 |
| 5,349,160 | 9/1994 | Hazan et al. | 219/250 |
| 5,531,037 | 7/1996 | Pons et al. . | |

STEAM IRON WITH ALL TEMPERATURE STEAM PRODUCTION

BACKGROUND OF THE INVENTION

1. Field of the Invention

The present invention relates to steam irons and, more particularly, to an iron with variable steam production.

2. Prior Art

U.S. Pat. No. 2,887,800 discloses a rotary dial on a steam iron for simultaneously controlling the temperature control of the iron and a water metering valve. U.S. Pat. No. 2,317,706 discloses two separate controls for a thermostat and a water valve. The valve stem is axially rotated to longitudinally move the valve stem relative to a valve member.

SUMMARY OF THE INVENTION

In accordance with one embodiment of the present invention a steam iron is provided having a housing with a water reservoir, a soleplate, a temperature control connected to the soleplate, a valve between the water reservoir and the soleplate, and a connection between the temperature control and a valve stem of the valve for varying water flow through the valve based upon temperature setting of the temperature control. The valve stem is connected to the temperature control by the connection to axially rotate the valve stem when the temperature control is moved, without longitudinally moving the valve stem relative to a valve member of the valve, to vary the flow of water through the valve.

In accordance with another embodiment of the present invention a steam iron is provided comprising means for moving a valve stem and means for varying flow of water from a reservoir to the soleplate. The means for moving the valve stem can move the valve stem among three positions including a closed position, a non-variable flow open position, and a variable flow position. The valve is located between the reservoir and the soleplate. The means for varying flow is adapted to vary the flow of water from the reservoir to the soleplate when the valve is in the variable flow position. The means for varying flow varies the flow of water by axially rotating the valve stem based upon movement of a temperature control of the iron. The means for varying flow only varies the flow of water through the valve based upon axial rotation of the valve stem when the valve stem is located in the variable flow position.

In accordance with another embodiment of the present invention a steam iron is provided having a soleplate, a temperature control and a water reservoir. The steam iron further comprises a valve and a transmission mechanism. The valve is located between the water reservoir and the soleplate. The valve has a rotatable valve stem and a valve member. The transmission mechanism connects the valve stem to the temperature control such that movement of the temperature control axially rotates the valve stem. The valve stem has a section with a perimeter channel that varies in area at different radial positions. The valve member has an inlet and an outlet such that water can travel from the inlet through the perimeter channel and out the outlet. Axial rotation of the valve stem changes the area of the channel between the inlet and outlet to vary the flow of water through the valve.

In accordance with one method of the present invention a method of assembling a steam iron is provided comprising steps of providing a valve with a valve stem and a valve member, the valve stem having a section with a channel along a perimeter, the channel varying in size at different radial positions, and the valve member having a main hole with an inlet and an outlet that are angularly offset from each other relative to a center axis of the main hole; and connecting a transmission between a temperature control of the iron and the valve stem such that movement of the temperature control axially rotates the valve stem.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
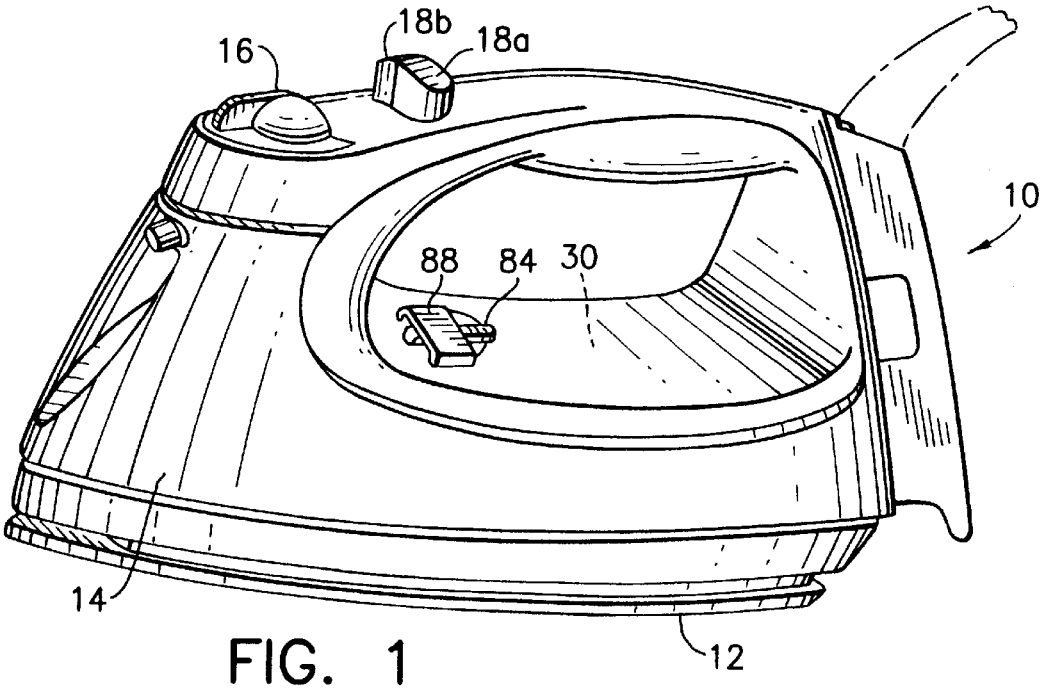
FIG. 1 is a perspective view of an iron incorporating features of the present invention.

Referring to FIG. 1, there is shown an electric steam iron 10 incorporating features of the present invention. Although the present invention will be described with reference to the single embodiment shown in the drawings, it should be understood that the present invention may be incorporated into various different types of alternate embodiments of irons. In addition, any suitable size, shape or type of elements or material could be used.

Figure 2:
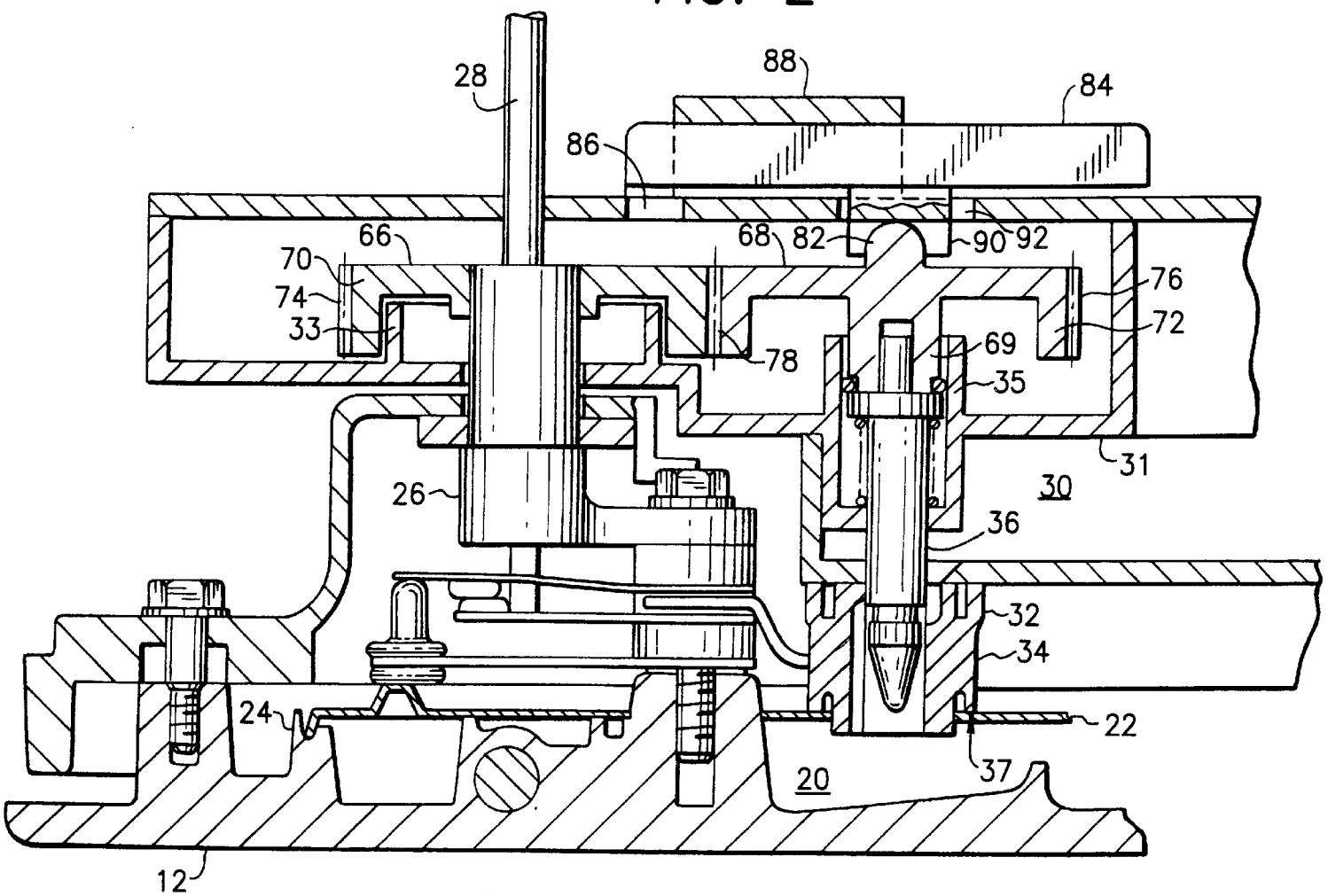
FIG. 2 is a schematic cross-sectional view of the lower front portion of the iron shown in FIG. 1.

The iron 10 generally comprises a soleplate 12, a housing 14, a temperature control knob 16, a spray button 18*a* and a surge button 18*b*. Referring also to FIG. 2 a partial cross-sectional view of the front of the iron is shown. The soleplate 12 has a raised wall 24 in a general triangular shape that forms the side walls for the steam chamber 20. A cover 22 is attached to the top of the wall 24 to form the top of the steam chamber. A thermostat 26 is mounted on the soleplate 12 and connected to the temperature control knob 16 by the shaft 28. The housing 14 includes a water reservoir 30. A valve 32 is provided between the reservoir 30 and the soleplate 12.

Figure 4:
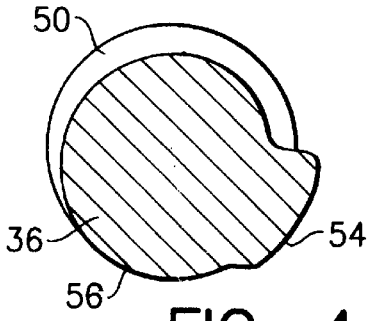
FIG. 4 is a cross-sectional view of the valve stem.
Figure 5:
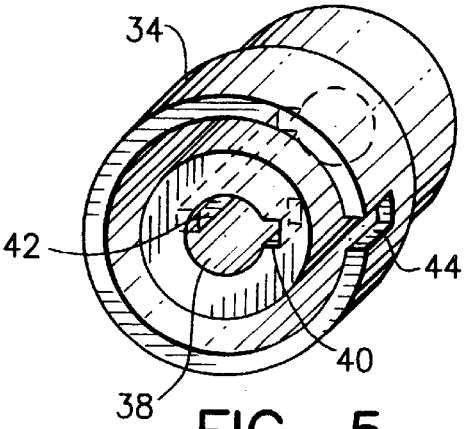
FIG. 5 is a perspective view of the valve member.
Figure 3A:
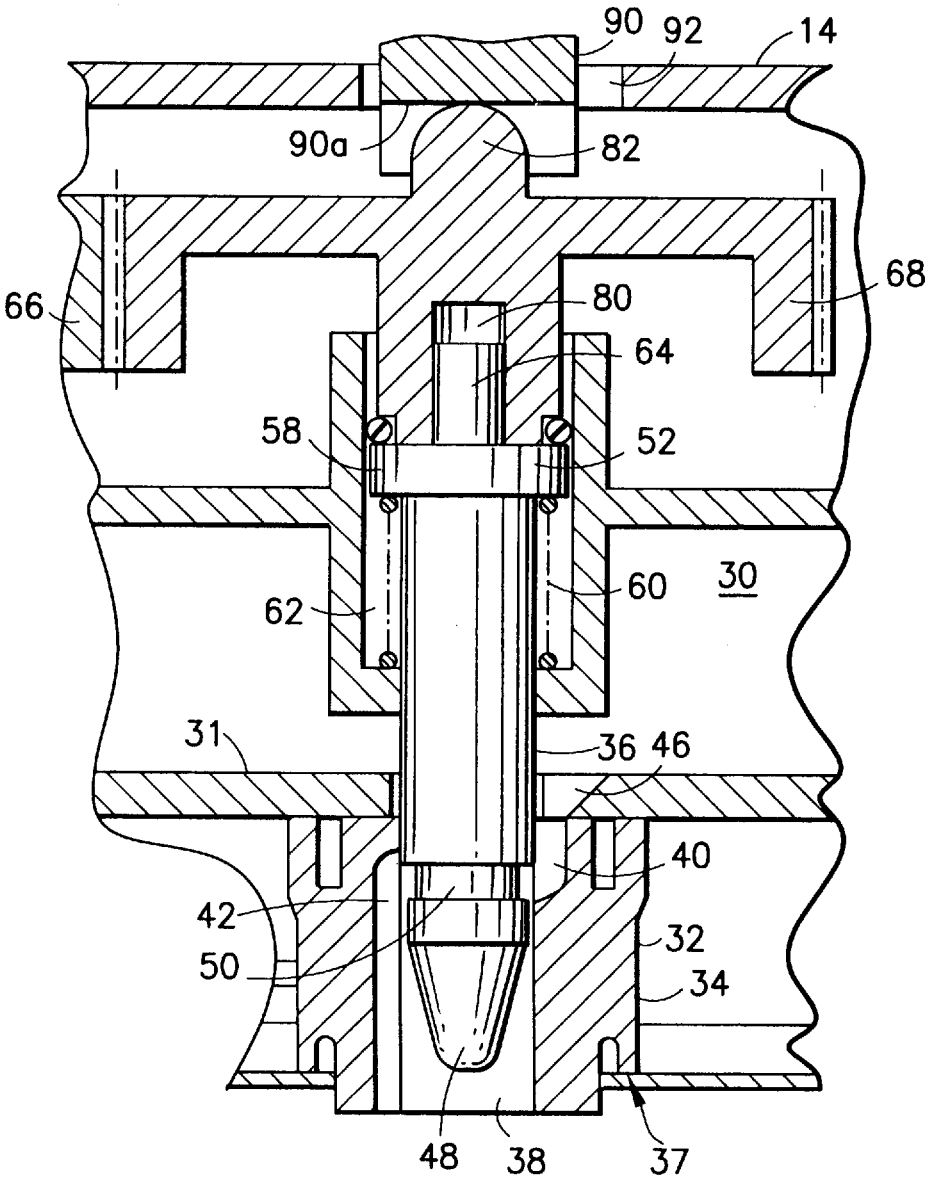
FIG. 3A is an enlarged cross-sectional view of the valve shown in FIG. 2.

The valve 32 includes a valve body or member 34 and a valve stem 36. The valve member 34 is mounted on the steam chamber cover 22 and forms a valve seat 37. Referring also to FIGS. 3*a* and 5, the valve member 34 has a main hole 38, an inlet 40, an outlet 42, and an alignment notch 44. The inlet 40 and the outlet 42 are both located at the main hole 38, but are radially offset from each other relative to a center axis of the hole 38. An exit 46 is provided at the bottom of the reservoir 30 at the inlet 40. The valve stem 36 has a bottom cone 48, a groove 50 at a section above the bottom of cone 48, and a top section 52. Referring also to FIG. 4, a cross-sectional view of the stem 36 at the groove 50 is shown. As seen, the depth of the groove 50 varies at different radial positions. The groove 50 does not extend entirely around the perimeter of the stem 36. Thus, the area of the groove 50 varies with the radial position on the stem 36. The stem 36 also has a protrusion 54 at the end of the groove 50. A portion 56 of the stem between the protrusion 54 and the groove 50 does not have either the groove or the protrusion. FIGS. 2 and 3*a* show the valve stem 36 in an open variable flow position relative to the member 34. The groove 50 is in the same plane as a top portion of the outlet 42 and a bottom portion of the inlet 40. The variable flow position will be described in further detail below.

The top section 52 of the stem 36 has a rim 58 and a stud 64. The temperature control shaft 28 is connected to the valve stem 36 by two gears 66, 68. The first gear 66 is connected to the shaft 28 such that axial rotation of the shaft 28 axially rotates the first gear 66. The second gear 68 is mounted on the top stud 64 of the valve stem 36. The two gears 66, 68 have relatively broad outer perimeters 70, 72 with teeth 74, 76, respectively. The teeth 74, 76 are intermeshed at a junction 78 of the two gears. The stud 64 has a keyed shape. The bottom center of the second gear 68 has a keyed aperture 80. The stud 64 is located in the aperture 80 such that axial rotation of the second gear 68 axially rotates the valve stem 36. A spring 60 is provided in a spring cavity 62 of the housing. The spring 60 is in contact with the bottom of the rim 58 and biases the valve stem 36 in an upward direction. The bottom of the second gear's center rests against the top of the rim 58. Therefore, the second gear 68 is also biased in an upward direction. The top center of the second gear 68 has a rider protrusion 82. As seen best in FIGS. 1 and 2, mounted to the housing 14 is a user actuatable selector 84. The selector 84 is a lever pivotably mounted to the housing 14 at pivot 86 and captured under a sleeve 88 of the housing 14. Located on the bottom of the selector 84 is a cam section 90 that projects through a hole 92 in the housing 14. The biasing action of the spring 60 biases the rider protrusion 82 against the bottom surface of the cam section 90. The bottom surface of the cam section 90 forms a cam surface.

Figure 3C:
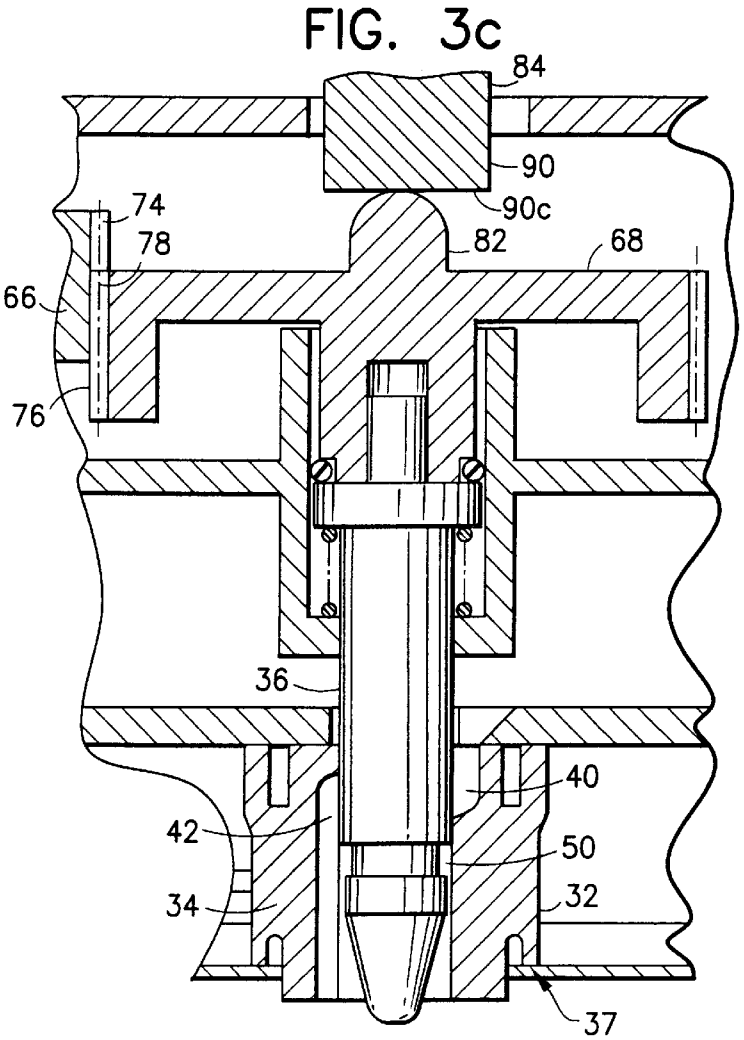
FIG. 3C is a cross-sectional as in FIG. 3B showing the valve stem at a fully closed position.
Figure 3B:
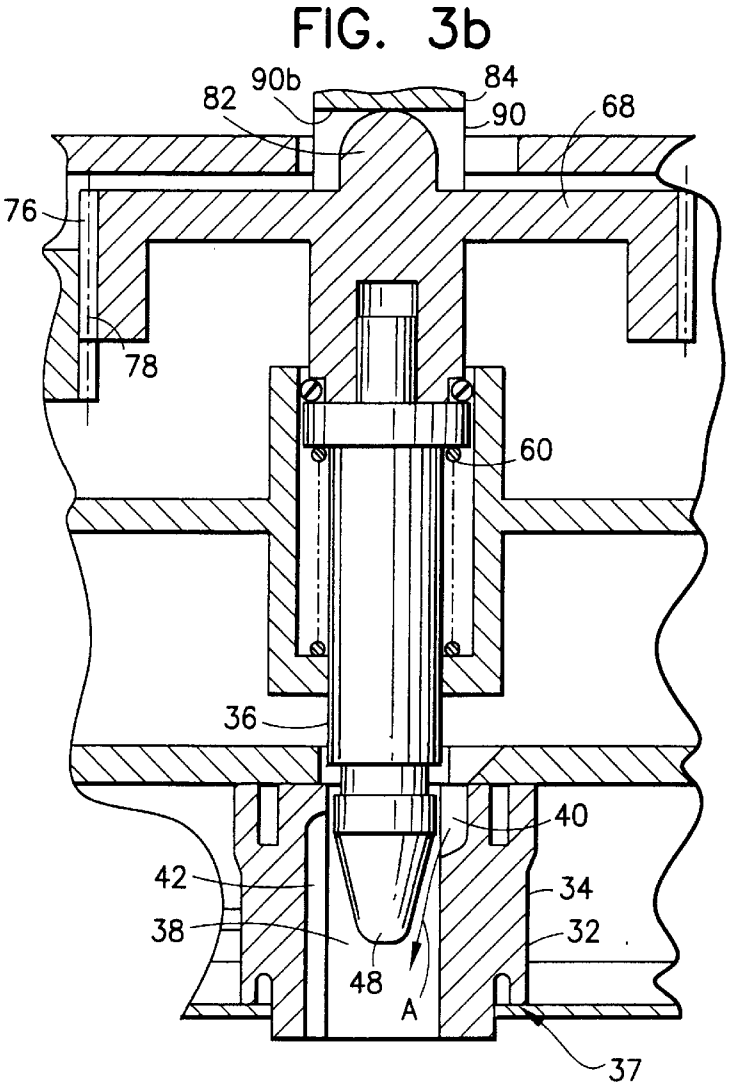
FIG. 3B is a cross-sectional view as in FIG. 3A showing the valve stem at an open non-variable position.

Referring now to FIGS. 3*a*, 3*b* and 3*c*, the operation of the selector 84 will be described. FIG. 3*c* shows the selector 84 at a first closed position. In this first closed position the lowest surface 90*c* of the cam section 90 is in contact with the rider protrusion 82. The cam section 90 holds the second gear 68 in a down position. The second gear teeth 76 remain in contact with the first gear teeth 74 at the junction 78 in this down position of the second gear 68. Because of the connection of the second gear 68 on top of the valve stem 36, the valve stem 36 is also located at a down position when the second gear 68 is at its down position. In the down position of the valve stem 36, the portion of the valve stem above the groove 50 is located between the inlet 40 and the outlet 42 of the valve member 34 and, more specifically, blocks the inlet 40 from the main hole 38. Therefore, water cannot flow from the inlet 40 to the outlet 42. Because the first gear 66 is still operably mated with the second gear 68, rotation of the temperature control knob 16 (see FIG. 1) still rotates the shaft 28 (see FIG. 2), first gear 66, second gear 68 and valve stem 36, but has no effect on flow of water through the valve.

FIG. 3*a* shows the selector 84 at a second open variable flow position. In this second position the intermediate surface 90*a* of the cam section 90 is in contact with the rider protrusion 82. The cam section 90 and spring 60 cooperate to hold the second gear 68 in the second variable flow position. The second gear teeth 76 remain in contact with the first gear teeth 74 at the junction 78. Because of the connection of the second gear 68 on top of the valve stem 36, the valve stem 36 is also located at the variable flow position. In this intermediate variable flow position, the groove 50 is aligned between the bottom of the inlet 40 and the top of the outlet 42 in the valve member 34. Thus, it is possible for water to flow from the inlet 40, through the groove 50, and out the outlet 42 to the soleplate 12. However, referring also to FIG. 4, because of the non-uniform shape of the groove 50, the rate of flow of water through the valve at this second variable flow position is dependent upon the axial position of the valve stem 36 relative to the valve member 34. The valve member 34 is prevented from axially rotating because of an interlocking engagement of a portion of the reservoir tank 31 with the alignment notch 44 (see FIG. 5). Because of the connection of the temperature control knob 16 (see FIG. 1) to the valve stem 36 via the shaft 28 (see FIG. 2) and two gears 66, 68, movement of the knob 16 axially rotates the valve stem 36. When the knob 16 is at an OFF position, the axial position of the valve stem 36 is such that the protrusion 54 blocks the bottom of the inlet 40. Therefore, no water flows through the valve with the knob 16 at the OFF position. When the knob 16 is rotated by a user from the OFF setting, the valve stem 36 is axially rotated to open a path via the groove 50 from the inlet 40 to the outlet 42. The more the knob 16 is rotated away from the OFF setting, the higher the setting of the thermostat 26 (see FIG. 2) and the larger the area of the path by the groove 50 between the inlet 40 and outlet 42. Therefore, the rate of flow of water through the valve is correlated to the temperature setting selected by the user. A low temperature setting will have a small rate of flow of water through the valve. This will help to insure that water is transformed into steam at a low temperature setting and thereby prevent water spotting problems. However, at a high temperature setting, a sufficient rate of flow is provided to allow for a good quality and quantity of steam generation at the higher temperature. The rate of flow of water through the valve is, thus, dependent upon the temperature setting of the iron when the valve stem is at its variable flow position.

FIG. 3*b* shows the selector 84 at a third non-variable open flow position. In this position, the upper surface 90*b* of the cam section 90 is in contact with the rider protrusion 82. The cam section 90 and spring 60 cooperate to hold the second gear 68 in the up position. The second gear teeth 76 remain in contact with the first gear teeth 74 at the junction 78. Because the spring 60 biases the valve stem 36 in an upward direction, the valve stem 36 is located at the non-variable open flow position. In this position, the top of the bottom cone section 48 of the valve stem 36 is located at the bottom of the inlet 40. This allows water to flow directly from the inlet 40, through the main hole 38, and into the chamber 20 of the soleplate as seen by arrow A without having to travel through the groove 50 or the outlet 42. The non-variable open flow position allows a self-cleaning function of the iron to be performed by the user. Because the gears 66, 68 are still operably connected to each other by their teeth, movement of the knob 16 will axially rotate the valve stem 36, but this will not affect flow of water through the valve.

The present invention allows the valve stem 36 to be longitudinally moved among the three positions shown in FIGS. 3*a*, 3*b* and 3*c*. When the valve stem 36 is located at the intermediate position shown in FIG. 3*a*, axial rotation of the valve stem 36 varies the rate of flow of water through the valve. The gears 66, 68 remain operably connected to each other to prevent misalignment problems. Preferably, both of the gears 66, 68 are rotatably mounted on portions of the tank 31 to keep the two gears 66, 68 engaged with each other. This is shown best in FIG. 2 with section 33 inside the first gear 66 and section 69 of the second gear 68 inside the section 35. With the present invention, a variable rate of continuous steam is possible from the lowest temperature setting to the highest temperature setting. It allows a user to have steam at a low setting of 220° F., such as for ironing acrylic or acetate material. In alternate embodiments, other types of configurations could be possible, such as an embodiment where axial rotation of the valve stem moves the valve to the three closed, open/variable and open/non-variable positions and longitudinal movement of the valve stem varies the rate of flow when the valve stem is at the open/variable position. Other alternate structural details and embodiments could also be designed by people skilled in the art.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In a steam iron having a housing with a water reservoir, a soleplate, a temperature control connected to the soleplate, a valve between the water reservoir and the soleplate, and a connection between the temperature control and a valve stem of the valve for varying water flow through the valve based upon temperature setting of the temperature control, wherein the improvement comprises:

the valve stem being connected to the temperature control by the connection to axially rotate the valve stem when the temperature control is moved, without longitudinally moving the valve stem relative to a valve member of the valve, to vary the flow of water through the valve; and a mechanism to longitudinally move the valve stem between a variable flow position and a non-variable flow open position, the non-variable flow open position maintaining the valve in an open position regardless of rotational position of the valve stem.

2. A steam iron as in claim 1 wherein the valve stem has a section with a groove along a portion of its perimeter.

3. A steam iron as in claim 2 wherein the groove varies in depth along the portion of the perimeter of the valve stem.

4. A steam iron as in claim 3 wherein a path of the groove is less than the circumference of the valve stem.

5. A steam iron as in claim 1 wherein the connection of the valve stem to the temperature control comprises a first gear on the temperature control and a second intermeshing gear on the valve stem.

6. A steam iron as in claim 5 wherein the second gear is longitudinally movable along its axis of rotation between an up position when the valve stem is in its non-variable flow open position and another position when the valve stem is in its variable flow position, wherein the first and second gears remain intermeshed in the two positions.

7. A steam iron as in claim 6 wherein the mechanism can longitudinally move the valve stem between the variable flow position and a closed position, wherein the second gear is longitudinally moved to a down position when the valve stem is moved to the closed position, but the first and second gears remain intermeshed in the down position.

8. A steam iron comprising:

means for moving a valve stem of a valve among a closed position, a non-variable flow open position, and a variable flow position, the valve being located between a reservoir and a soleplate of the iron; and means for varying flow of water from the reservoir to the soleplate when the valve stem is in the variable flow position by axially rotating the valve stem based upon movement of a temperature control of the iron;

wherein the means for varying flow only varies the flow of water through the valve based upon axial rotation of the valve stem when the valve stem is located in the variable flow position and wherein the means for moving the valve stem includes a user actuated selector on a housing of the steam iron that longitudinally moves the valve stem up and down between the variable flow position and the non variable flow open position separate from axial rotation of the valve stem.

9. A steam iron as in claim 8 wherein the means for varying flow comprises a groove on the valve stem, the groove varying in size along different radial positions of the valve stem.

10. A steam iron as in claim 8 wherein the means for varying flow comprises a first gear on the temperature control and a second gear on the valve stem.

11. A steam iron as in claim 10 wherein the first and second gears remain operationally connected to each other when the valve stem is located at the non-variable flow open position and the closed position.

12. A steam iron having a soleplate, a temperature control, and a water reservoir, the steam iron comprising:

a valve located between the water reservoir and the soleplate, the valve having a rotatable valve stem and a valve member;

a transmission mechanism connecting the valve stem to the temperature control such that movement of the temperature control axially rotates the valve stem; and a mechanism to longitudinally move the valve stem up and down between a variable flow position and a nonvariable open flow position separate from axial rotation of the valve stem, the mechanism including a user actuated selector;

wherein the valve stem has a section with a perimeter channel that varies in area at different radial positions and the valve member has an inlet and an angularly offset outlet such that water can travel from the inlet through the perimeter channel and out the outlet and, axial rotation of the valve stem changes the area of the channel between the inlet and outlet to vary the flow of water through the valve.

13. A steam iron as in claim 12 wherein the channel has different depths at different radial positions and does not extend around the entire perimeter of the valve stem.

14. A steam iron as in claim 12 wherein a path is open by the channel between the inlet and the outlet for substantially all settings of the temperature control when the valve stem is at a variable flow position.

15. A method of assembling a steam iron comprising steps of:

providing a valve with a valve stem and a valve member, the valve stem having a section with a channel along a perimeter, the channel varying in size at different radial positions, the valve member having a main hole with an inlet and an outlet that are angularly offset from each other relative to a center axis of the hole; and connecting a transmission between a temperature control of the iron and the valve stem such that movement of the temperature control axially rotates the valve stem; and connecting a user actuating mechanism to the valve stem to longitudinally move the valve stem between a non-variable flow open position and a variable flow position irrespective of axial rotation and rotational position of the valve stem.

16. A method of varying the flow of steam in a steam iron in accordance with changes in the temperature setting of the iron comprising the steps of:

providing a temperature control to regulate the temperature of a soleplate of the iron;

providing a fluid flow control to regulate the flow of water from a water reservoir to a steam chamber of the iron;

axially moving the fluid flow control independently of the temperature control to establish first, second and third modes of iron operation, with a first mode being dry operation, the second mode being variable steam operation and the third mode being self-clean of the fluid flow control; and directly varying the rate of the flow of water from the reservoir to the steam chamber in accordance with changes in the temperature setting of the temperature control when the iron is in the second mode of operation.

17. A method of varying the flow of steam in accordance with claim 16 wherein varying the rate of flow of water is accomplished by:

rotating the fluid flow control about a vertical axis.

* * * * *